US009442413B2

(12) United States Patent
Okugawa et al.

(10) Patent No.: US 9,442,413 B2
(45) Date of Patent: Sep. 13, 2016

(54) IMAGE FORMING APPARATUS AND EXPOSURE POSITION ADJUSTING METHOD

(71) Applicant: Konica Minolta, Inc., Tokyo (JP)

(72) Inventors: Yuji Okugawa, Tokyo (JP); Katsuyuki Hirata, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/721,578

(22) Filed: May 26, 2015

(65) Prior Publication Data

US 2015/0346627 A1 Dec. 3, 2015

(30) Foreign Application Priority Data

May 30, 2014 (JP) ..... 2014-113291

(51) Int. Cl.
*G03G 15/043* (2006.01)
*G03G 15/00* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5058; G03G 15/5041; B41J 2/435; B41J 2/473
See application file for complete search history.

(56) References Cited

U.S. PATENT DOCUMENTS 6,831,672 B2 * 12/2004 Maeda ..... G03G 15/305 250/205
7,425,975 B2 * 9/2008 Ono ..... B41J 2/473 347/233
2011/0205324 A1 * 8/2011 Shukuya ..... B41J 2/473 347/116
2013/0208069 A1 8/2013 Zaima et al.

FOREIGN PATENT DOCUMENTS

EP 1243979 A1 9/2002
JP 10-62705 A 3/1998
JP 2007133056 A 5/2007
JP 2010197072 A 9/2010

OTHER PUBLICATIONS

European Search Report; Application No. 15164819.3-1560 / 2950152; Issued Jan. 12, 2015; Applicant: Konica Minolta, Inc.; total of 5 pages.

* cited by examiner

*Primary Examiner* — Sandra Brase
(74) *Attorney, Agent, or Firm* — Lucas & Mercanti, LLP

(57) ABSTRACT

In one aspect of the present invention, exposure timings for a plurality of light beams are adjusted on the basis of a toner concentration of a boundary part between line images formed by one light beam and line images formed by another light beam neighboring the one light beam and a toner concentration of a part except the boundary part in a pattern image. Here, in the pattern image, line images extending in the main-scan direction of a photoreceptor are formed while having a predetermined pitch in the sub-scan direction of the photoreceptor and also the boundary part is arranged so as to be shifted from the sub-scan direction of the photoreceptor, by an image forming section.

7 Claims, 9 Drawing Sheets

CONDITION A

CONDITION B

CONDITION C

CONDITION A

CONDITION B

CONDITION C

IMAGE FORMING APPARATUS AND EXPOSURE POSITION ADJUSTING METHOD

CROSS REFERENCES TO RELATED APPLICATIONS

Background of the Invention

1. Field of the Invention

The present invention relates to a multi-beam type image forming apparatus and an exposure position adjusting method, and particularly relates to a technique of adjusting the beam pitch of a plurality of light beams in the main-scan direction.

2. Background Art

Conventionally, there has been used an image forming apparatus provided with a multi-beam exposing portion which scans a photoreceptor with a plurality of light beams at the same time, in response to a demand for a higher speed in image output. For obtaining a higher image quality in such an image forming apparatus, it is important to appropriately adjust the beam pitch (interval) of the plurality of light beams scanning the photoreceptor in the main-scan direction and the sub-scan direction.

Generally, in the image forming apparatus, rough adjustment is performed in the multi-beam exposing portion alone (without the output of an evaluation pattern image). After that, when the multi-beam exposing portion is attached to an actual apparatus, the evaluation pattern image is output while the exposure start timing of each light source is being changed, and fine adjustment (adjustment in consideration of the influence of the other units such as the photoreceptor) is performed by an adjustment worker who evaluates the evaluation pattern image visually.

For example, regarding the adjustment of the beam pitch in the sub-scan direction, there is disclosed a technique of outputting an evaluation image pattern for detecting a small variation in the beam pitch of a plurality of light beams in the sub-scan direction (e.g., see patent literature 1).

Further, there is disclosed an evaluation chart which enables irradiation position shifts of a plurality of light beams in the sub-scan direction to be checked easily (e.g., see patent literature 2).

Further, there is disclosed an evaluation chart which enables the variation of the light beam pitch in the sub-scan direction to be detected precisely (e.g., see patent literature 3). The evaluation chart is configured with an image pattern in which an n-dot line ($n \geq 2$) formed in the main-scan direction is repeated in a period of an integral multiple of the number of the light beams in the sub-scan direction, and includes an image evaluation pattern configured with an image pattern which is formed by a combination of a plurality of different light beams and arranged in plurality side by side in the main-scan direction.

DESCRIPTION OF THE RELATED ART

Patent Literature

Patent literature 1: Japanese Patent Application Laid-Open Publication No. 2007-133056

Patent literature 1: Japanese Patent Application Laid-Open Publication No. 2010-197072

Patent literature 1: Japanese Patent Application Laid-Open Publication No. H10-62705

SUMMARY OF THE INVENTION

Problem to be Solved by the Invention

The conventional adjustment by the image output is performed such that an adjustment worker visually checks a shift amount of the evaluation image pattern which enables a pitch shift in the main-scan direction to be checked visually, and, after that, inputs an adjustment value according to the shift amount into the image forming apparatus. Accordingly, the influence of the technical ability of the adjustment worker (e.g., the visibility of yellow is lower than those of the other colors and observation is performed under irradiation of blue light onto the evaluation image pattern) is large, and sometimes a poor image is formed because of adjustment variation.

Further, since the process of the adjustment and check after the output of the evaluation image pattern is repeated until the pitch shift disappears, the adjustment work is performed plural times. Accordingly, adjustment time becomes long, and also the number of sheets for outputting the evaluation image pattern is increased, which leads to cost increase. If the above adjustment and check work is performed by a service person after the shipment of the image forming apparatus, the work of the service person requires a high cost.

Further, since the line width of the evaluation image pattern output on a sheet (overlap state (black line) or separation state (white line) of line images configuring the evaluation image pattern) is evaluated visually, precise work is difficult because of the influence of an image line (black line or white line).

FIG. 9 shows an example of the evaluation image pattern which is obtained by performing exposure scanning of a photoreceptor with light beams emitted from a plurality of light sources. The evaluation image pattern has a plurality of line images which has a predetermined pitch in the sub-scan direction of the photoreceptor and also is arranged periodically in the main-scan direction corresponding to the plurality of light beams, for example. The example of FIG. 9 shows evaluation image patterns 301 to 303 exposed in three different conditions A to C by an exposing portion having eight light sources (sometimes described as "LD1" to "LD8"). Here, explanation will be made focusing on line images by LD1 and line images by LD8.

The interval of the line images by LD1 and LD8 in each of the conditions A to C is as follows.

In condition A, since the timing of exposure (hereinafter, called "exposure timing") by LD8 is advanced from that by LD1, an overlap part 301D is generated between line images by LD8 and line images by LD1 on the left side of LD8, and also a separation part 301A is generated between the line images by LD8 and line images by LD1 on the right side of LD8.

In condition B, the exposure timing of LD8 is appropriate and there is no overlap or separation between line images by LD8 and line images by LD1 on the left or right side thereof, and an appropriate interval is kept between the line images by LD1 and line images by LD8.

In condition C, since the exposure timing of LD8 is delayed from that of LD1, a separation part 303A is generated between the line images by LD8 and line images by LD1 on the left side thereof and also an overlap part 303D is generated between the line images by LD8 and line images by LD1 on the right side thereof.

In the example of FIG. 9, the beam pitch of the light beams in the main-scan direction is uniform in condition B. In this manner, by observing the overlap state or the separation state of the line images in the evaluation image pattern, it is possible to determine whether the exposure timing in each of the light sources is appropriate or not.

As shown in FIG. 10A-10F, however, when process noise such as a black line 304B exists at a position for the determination shown by an arrow (boundary of line image repetition), it is difficult to perform a precise determination.

Any of the techniques according to above patent literatures 1 to 3 relates to the formation of the evaluation chart for determining whether the beam pitch in the sub-scan direction is good or not, and does not perform automatic correction of the beam pitch. Further, even by using the evaluation chart, it is not possible to simply determine or adjust the shift of the beam pitch, because of the influence of the process noise or the like generated after the exposure. Accordingly, even when the beam pitch is adjusted based on the evaluation chart, there is a possibility that a poor image is generated because of the process variation after that.

From the above situation, it is desired to obtain a method capable of appropriately adjusting the beam pitch of the plurality of light beams in the main-scan direction, even when the process noise or the like is generated after the exposure.

Means for Solving the Problem

In one aspect of the present invention, an image forming section forms a pattern image in which line images extending in a main-scan direction of a photoreceptor are formed periodically while having a predetermined pitch in a sub-scan direction of the photoreceptor by scanning of the photoreceptor with a plurality of light beams emitted from an exposing portion, and also a boundary part between line images formed by one light beam and line images formed by another light beam neighboring the one light beam is arranged so as to be shifted from the sub-scan direction of the photoreceptor. Next, a toner concentration detecting section detects a toner concentration of the pattern image on the photoreceptor or the transferred pattern image which has been transferred from the photoreceptor to a transfer material. Then, a control section calculates exposure timings for the plurality of light beams in the image forming section on the basis of a toner concentration of the boundary part and a toner concentration of a part except the boundary part, the toner concentrations being detected by the toner concentration detecting section.

The above neighboring light beams include light beams emitted by neighboring light sources among a plurality of light sources which is provided for the exposing portion and located apart from one another by certain distances in the main-scan direction and the sub-scan direction, and additionally include light beams having a nearest positional relationship among a plurality of light beams emitted from remaining light sources after the plurality of light sources has been thinned out according to image data.

In the above configuration, the exposure timings by the plurality of light beams are adjusted on the basis of the toner concentration of a boundary part between line images by one light beam and line images by another light beam and the toner concentration in a part except the boundary part in the pattern image. Here, in the pattern image, the line images extending in the main-scan direction of the photoreceptor are formed periodically while having a predetermined pitch in the sub-scan direction of the photoreceptor, and also the boundary part is arranged so as to be shifted from (not to coincident with or not to be parallel to) the sub-scan direction of the photoreceptor, by the image forming section.

DESCRIPTION OF THE PREFERRED EMBODIMENTS

Hereinafter, embodiments for carrying out the present invention will be explained in detail by the use of the drawings. Note that, in the following explanation and in each of the drawings, the same sign is attached to show the same element or an element having the same function, and duplicated explanation will be omitted.

1. First Embodiment

Configuration Example of an Image Forming Apparatus

First, an outline of an image forming apparatus according to an embodiment of the present invention will be explained with reference to FIG. 1.

Figure 1:
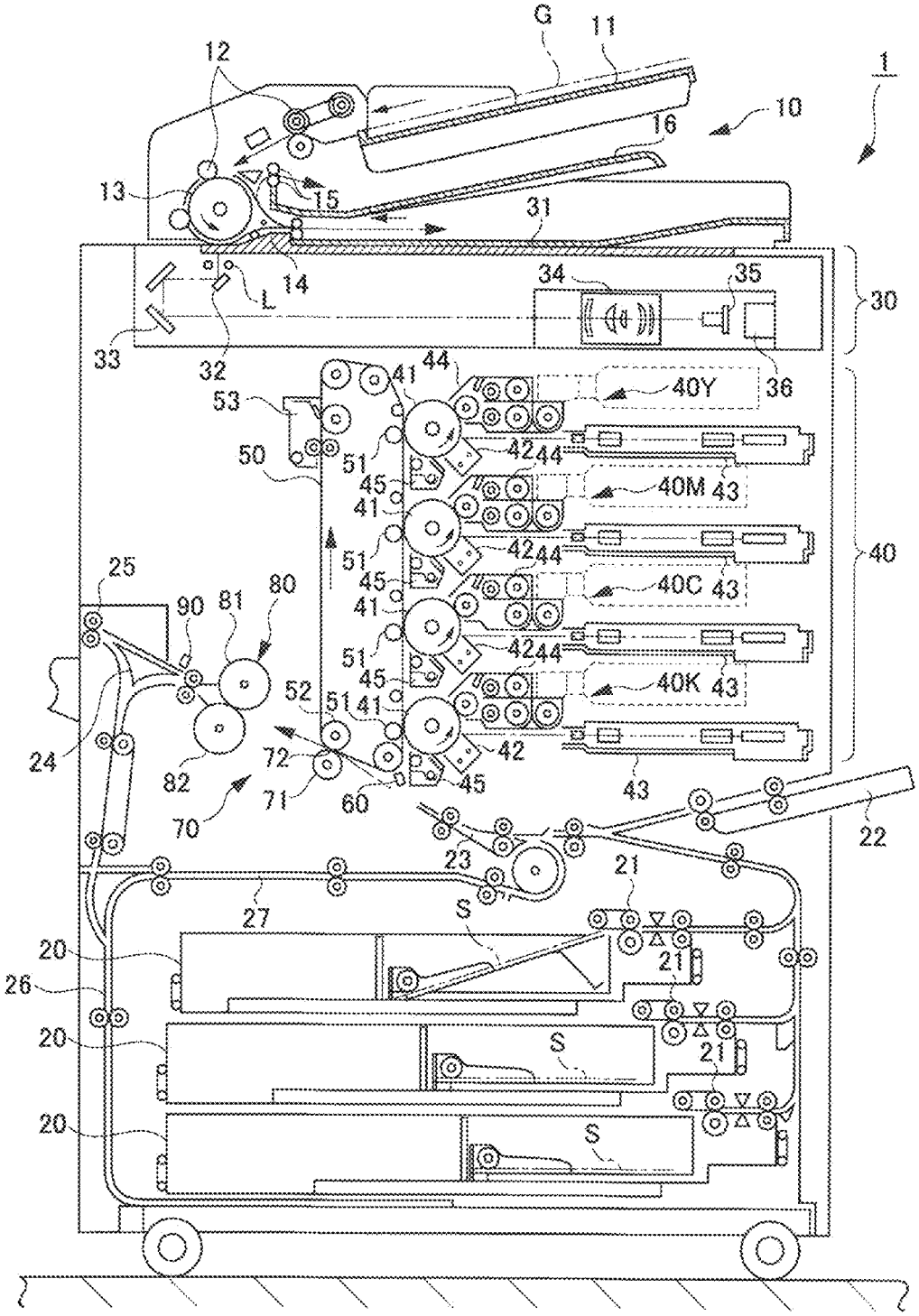
FIG. 1 is an entire configuration diagram showing an image forming apparatus according to a first embodiment of the present invention.

FIG. 1 is an entire configuration diagram showing the image forming apparatus according to an embodiment of the present invention.

As shown in FIG. 1, the image forming apparatus 1 forms an image on a sheet by an electrophotographic system, and is a tundem type color image forming apparatus which overlaps toners of four colors; yellow (Y), magnta (M), cyan (C), and black (Bk). The image forming apparatus 1 includes a document conveying section 10, a sheet accommodating section 20, an image reading section 30, an image forming section 40, an intermediate transfer belt 50, a secondary transfer section 70, and a fixing section 80.

The document conveying section 10 includes a document feed tray 11 where a document G is set, a plurality of rollers 12, a conveying drum 13, a conveying guide 14, a document ejecting roller 15, and a document receiving tray 16. The document G set on the document feed tray 11 is conveyed sheet by sheet to a read position of the image reading section 30 by the plurality of rollers 12 and the conveying drum 13. The conveying guide 14 and the document ejecting roller 15 eject the document G conveyed by the plurality of rollers 12 and the conveying drum 13, into the document receiving tray 16.

The image reading section 30 reads the image of the document G conveyed by the document conveying section 10 or the image of the document placed on a platen 31, to generate image data. Specifically, the image of the document G is irradiated by a lamp L. The reflected light from the document G is guided to a first mirror unit 32, a second mirror unit 33, a lens unit 34, in this order, to form an image on a light receiving face of an imaging element 35. The imaging element 35 photoelectrically converts the incident light to output a predetermined image signal. The output image signal is A/D converted to generate image data.

Further, the image reading section 30 includes an image reading controlling portion 36. The image reading controlling portion 36 applies processing such as shading correction, dithering processing, and compression processing to the image data generated by the A/D conversion, and stores the image data into a RAM 103 (refer to FIG. 2). Here, the image data is not limited to the data output from the image reading section 30, and may be image data received from an external apparatus such as a personal computer and another image forming apparatus which are connected to the image forming apparatus 1.

The sheet accommodating section 20 is arranged in the lower part of an apparatus main body, and provided in plurality according to the sizes and kinds of the sheet. The sheet is fed by a sheet feeding section 21 to be sent to a conveying section 23, and conveyed by the conveying section 23 to the secondary transfer section 70 having a transfer position. That is, the conveying section 23 performs a function of conveying the sheet fed from the sheet feeding section 21 to the secondary transfer section 70, and forms a conveying path for conveying the sheet. Further, a manual insertion section 22 is provided near the sheet accommodating section 20. From the manual insertion section 22, a special sheet, such as a sheet having a size not accommodated in the sheet accommodating section 20, a tag sheet having a tag, and an OHP sheet or the like, is fed to the transfer position. In FIG. 1, sign S is attached to a sheet fed from the sheet feeding section 21.

The image forming section 40 and the intermediate transfer belt 50 are arranged between the image reading section 30 and the sheet accommodating section 20. The image forming section 40 includes four image forming units 40Y, 40M, 40C and 40K for forming a toner image of yellow (Y), a toner image of magenta (M), a toner image of cyan (C), and a toner image of black (Bk).

The first image forming unit 40Y forms the toner image of yellow, the second image forming unit 40M forms the toner image of magenta. Further, the third image forming unit 40C forms the toner image of cyan, and the fourth image forming unit 40K forms the toner image of black. The four image forming units 40Y, 40M, 40C, and 40K each have the same configuration, and therefore the first image forming unit 40Y will be explained here.

The first image forming unit 40Y including a drum-shaped photoreceptor 41, a charging portion 42 arranged around the photoreceptor 41, an exposing portion 43, a developing portion 44, and a cleaning portion 45. The photoreceptor 41 is rotated by an un-illustrated drive motor. The charging portion 42 provides charge for the photoreceptor 41 to charge the surface of the photoreceptor 41 uniformly. The exposing portion 43 forms an electrostatic latent image having spot shapes on the photoreceptor 41 by performing exposure scanning on the surface of the photoreceptor 41 according to the image data generated by the image reading section 30, the image data transmitted from the external apparatus, or the like.

The exposing portion 43 includes an un-illustrated plurality of light sources located apart from one another in the main-scan direction and the sub-scan direction, and a deflecting optical system. Each of the light sources emits alight beam corresponding to a pulse current input from a pulse generator (not shown in the drawing) according to the image data. The light beams emitted from the plurality of light sources are deflected at the same time in a target direction by the un-illustrated deflecting optical system. The deflecting optical system is configured using a collimator lens which converts the incident light beams into parallel light, a prism which converts the plurality of light beams into a plurality of light beams having a predetermined beam pitch, a collimator lens which collects the incident light beams, a poligon mirror which reflects the light beams incident from the collimator lens, a scanning lens which inputs the light beams incident from the poligon mirror onto the surface of the photoreceptor 41, and the like, for example. The exposing portion 43 deflects the plurality of light beams which is located apart from one another by certain distances in the main-scan direction and the sub-scan direction, at the same time, and scans the surface of the photoreceptor 41 periodically in the main-scan direction while having a predetermined pitch in the sub-scan direction, according to an instruction of a CPU 101 to be described below.

The developing portion 44 attaches yellow toner to the electrostatic latent image formed on the photoreceptor 41 using 2-component developer composed of toner and a carrier, for example. Thereby, a yellow toner image is formed on the surface of the photoreceptor 41.

Here, a developing portion 44 of the second image forming unit 40M attaches magenta toner to the photoreceptor 41, a developing portion 44 of the third image forming unit 40C attaches cyan toner to the photoreceptor 41. Further, a developing portion 44 of the fourth image forming unit 40K attaches black toner to the photoreceptor 41.

The toner images formed on the photoreceptors 41 are transferred onto the intermediate transfer belt 50. The intermediate transfer belt 50 is formed endlessly, and stretched across a plurality of rollers. The intermediate transfer belt 50 is driven to rotate in the direction opposite to the rotation (movement) direction of the photoreceptors 41, by an un-illustrated drive motor.

The cleaning portions 45 remove the toner remaining on the surfaces of the photoreceptors 41, after the toner images have been transferred onto the intermediate transfer belt 50.

In the intermediate transfer belt 50, four primary transfer sections 51 are arranged in positions facing the respective photoreceptors 41 of four image forming units 40Y, 40M, 40C, and 40K. Each of the primary transfer sections 51 transfers the toner image formed on the photoreceptor 41 onto the intermediate transfer belt 50 by applying a voltage having a polarity opposite to that of the toner to the intermediate transfer belt 50.

Then, by the rotational drive of the intermediate transfer belt 50, the toner images formed by the four image forming units 40Y, 40M, 40C, and 40K are transferred onto the surface of the intermediate transfer belt 50 sequentially.

Thereby, the toner images of yellow, magenta, cyan, and black are overlapped to form a color toner image onto the intermediate transfer belt 50.

A toner attachment amount detecting sensor 60 is provided near the intermediate transfer belt 50 on the downstream side of the four photoreceptors 41 in the sheet conveying direction. The toner attachment amount detecting sensor 60 detects the amount of the toner attaching to the intermediate transfer belt 50. So-called image stabilizing control is carried out as needed changing the process control condition of the image formation according to the detection result of the toner attachment amount detecting sensor 60.

Further, a belt cleaner 53 is provided facing the intermediate transfer belt 50. The belt cleaner 53 cleans the surface of the intermediate transfer belt 50 after the toner image has been transferred onto the sheet.

The secondary transfer section 70 is arranged near the intermediate transfer belt 50 and also on the downstream side of the conveying section 23 in the sheet conveying direction. The secondary transfer section 70 performs secondary transfer of the toner image formed on the outer circumference face of the intermediate transfer belt 50, onto the sheet.

The secondary transfer section 70 includes a secondary transfer roller 71. The secondary transfer roller 71 is press-contacted to a facing roller 52 sandwiching the intermediate transfer belt 50. A secondary transfer nip portion 72 is formed at a part where the secondary transfer roller 71 and the intermediate transfer belt 50 contact each other. The secondary transfer nip portion 72 is a transfer position where the toner image formed on the outer circumference face of the intermediate transfer belt 50 is transferred onto the sheet S.

The fixing section 80 is provided on a sheet ejection side of the secondary transfer section 70. The fixing section 80 presses and heats the sheet to fix the transferred toner image onto the sheet. The fixing section 80 includes a pair of fixing members of an upper fixing roller 81 and a lower fixing roller 82, for example. The upper fixing roller 81 and the lower fixing roller 82 are arranged in the state of being press-contacted with each other, and a fixing nip part is formed as a pressure contact part at a position where the upper fixing roller 81 and the lower fixing roller 82 contact each other.

A heating portion is provided inside the upper fixing roller 81. The outer circumference part of the upper fixing roller 81 is heated by radiation heat from the heating portion. Then, the heat of the upper fixing roller 81 is transferred to the sheet to fix the toner image thermally on the sheet.

The sheet is conveyed so that the face (fixing target face) having the toner image transferred by the secondary transfer section 70 and the upper fixing roller 81 face each other, and passes through the fixing nip part. Accordingly, the sheet passing through the fixing nip part is pressed by the upper fixing roller 81 and the lower fixing roller 82, and heated by the heat of the upper fixing roller 81.

On the downstream side of the fixing section 80 in the sheet conveying direction, a toner concentration sensor 90 (example of a toner concentration detecting section), which optically detects the image formed on the sheet having passed through the fixing section 80, is arranged so as to face the conveying path.

The toner concentration sensor 90 is a sensor to detect the toner concentration of the image transferred and fixed onto the sheet S across the whole area in the width direction of the sheet S (same direction as the main-scan direction of the image). Specifically, the toner concentration sensor 90 includes a sensor in which a plurality of photoelectric conversion elements is arranged linearly across the whole range in the width direction of the sheet S (so-called line sensor), a light source irradiating the image fixed onto the sheet S with light, and an optical system guiding the reflected light from the image fixed onto the sheet S to the line sensor. The line sensor may be a CCD type image sensor or a CMOS type (including MOS type) image sensor. The toner concentration sensor 90 like this is sometimes called an inline sensor. The toner concentration sensor 90 employs a line sensor capable of detecting an image having four colors of yellow, magenta, cyan, and black using a color filter.

Further, the toner concentration sensor 90 includes a signal processing circuit to process a sensor output of the line sensor in a pixel unit. The toner concentration sensor 90 is configured to regionally detect the color information, the print position information, and the like of the image across the whole range of the sheet S passing through the conveying path in the width direction and the conveying direction (same direction as the sub-scan direction of the image). Here, for the toner concentration sensor 90, it is also possible to use an image sensor in which photoelectric conversion elements are arranged in a matrix.

A switching gate 24 is arranged on the downstream side of the fixing section 80 in the sheet conveying direction. The switching gate 24 switches the sheet conveying path of the sheet which has passed through the fixing section 80. That is, the switching gate 24 causes the sheet to travel straight when performing the ejection of the sheet with the image side facing up in which the sheet is ejected so as to cause the image formation side to face up, in the case of one-side image formation. Thereby, the sheet is ejected by a pair of sheet ejecting rollers 25. Further, the switching gate 24 guides the sheet downward when performing the ejection of the sheet with the image side facing down in which the sheet is ejected so as to cause the image formation side to face down, in the case of the one-side image formation, and in the case of performing both-side image formation.

In the sheet ejection with the image side facing down, after the sheet has been guided downward by the switching gate 24, the sheet is turned over and conveyed upward by a sheet turn-over conveying section 26. Thereby, the sheet turned over to have the image formation side facing down is ejected by the pair of sheet ejecting rollers 25.

When the both-side image formation is performed, after the sheet has been guided downward by the switching gate 24, the sheet is turned over by the sheet turn-over conveying section 26 and sent again to the transfer position of the secondary transfer section 70 through a sheet re-feeding path 27.

A post processing device may be arranged on the downstream side of the pair of sheet ejecting roller 25 for folding the sheet or performing stapler processing or the like on the sheet.

[Control System Configuration of the Image Forming Apparatus]

Next, a control system of the image forming apparatus 1 will be explained with reference to FIG. 2.

Figure 2:
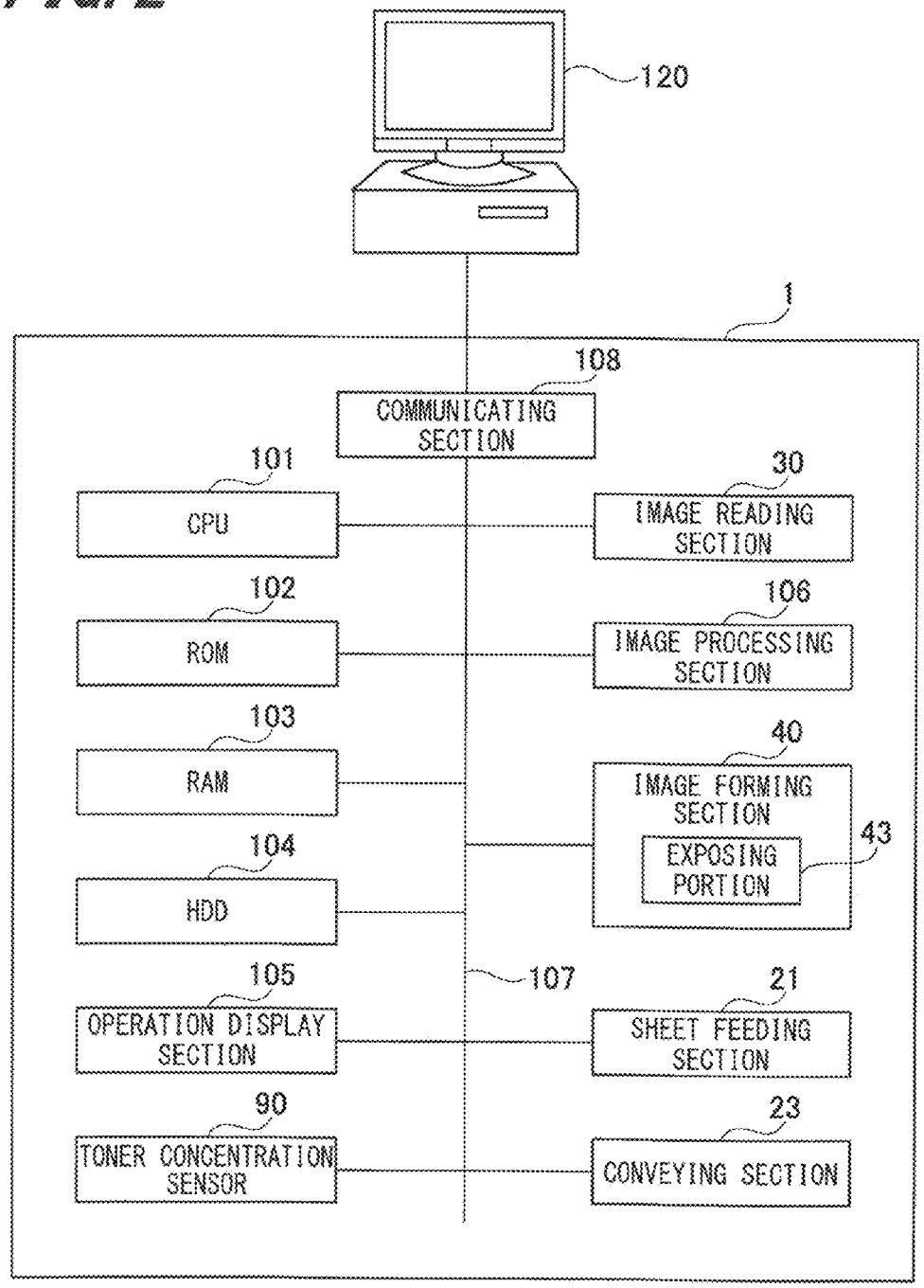
FIG. 2 is a block diagram showing a hardware configuration of an image forming apparatus according to the first embodiment.

FIG. 2 is a block diagram showing the control system of the image forming apparatus 1.

As shown in FIG. 2, the image forming apparatus 1 includes a CPU (Central Processing Unit) 101, a ROM (Read Only Memory) 102 for storing a program or the like to be executed by the CPU 101, and a RAM (Random Access Memory) 103 to be used for a work area of the CPU 101, for example. Further, the image forming apparatus 1 includes a hard disk drive (HDD) 104 as a large capacity storage device and an operation display section 105. Here, an electrically-erasable programmable ROM is used as the ROM 102, for example.

The CPU 101 is an example of a control section, and is connected to the ROM 102, the RAM 103, the HDD 104, and the operation display section 105 via a system bus 107 to control the entire apparatus. Further, the CPU 101 is connected to the image reading section 30, an image processing section 106, the image forming section 40, the sheet feeding section 21, and the conveying section 23, via the system bus 107.

The HDD 104 stores the image data of the document image which is obtained by the reading in the image reading section 30, and also stores already-output image data and the like. The operation display section 105 is a touch panel configured with a display such as a liquid crystal display device (LCD) or an organic ELD (Electro Luminescence Display). The operation display section 105 displays an instruction menu for a user, information related to the obtained image data, and the like. Further, the operation display section 105 is provided with a plurality of keys, receives various kinds of instruction by user's key operation, and receives inputs of data of characters, numerals, and the like, and outputs an input signal to the CPU 101.

The image data generated by the image reading section 30 and the image data transmitted from a PC (Personal Computer) 120 which is an example of an external apparatus connected to the image forming apparatus 1 are sent to the image processing section 106 to be image-processed. The image processing section 106 performs image processing such as shading correction, image intensity adjustment, and image compression, as needed on the received image data.

The image forming sections 40 receive the image data image-processed by the image processing section 106 and perform exposure onto the respective photoreceptors 41 by the exposing portions 43, the development by the developing portions 44, and the like, on the basis of the image data to form the image onto the sheet S.

The toner concentration sensor 90 sends the toner concentration detection result of the image on the sheet S to the CPU 101. The CPU 101 adjusts the exposure timings of the plurality of light beams in each of the exposing portions 43 according to the detection result sent from the toner concentration sensor 90. Thereby, the exposure positions of the plurality of light beams in the main-scan direction are adjusted, and resultantly the beam pitch of the plurality of light beams is adjusted. The exposure timing is defined by an exposure start timing and an exposure time, for example. In the present embodiment, the exposure time is assumed to be constant for the plurality of light beams in the beam pitch adjustment.

A communication section 108 receives job information transmitted from the PC 120 which is an external information processing apparatus, for example, via a communication line. Then, the received job information is sent to the CPU 101 via the system bus 107.

Note that, while an example of applying a personal computer as an external apparatus is explained in the present embodiment, the present embodiment is not limited to this case, and another type of apparatus such as a facsimile apparatus can be applied as an external apparatus, for example.

[Adjustment of Light Beam Exposure Timings]

The above image forming apparatus 1 performs processing of adjusting the exposure timings of the plurality of light beams in the main-scan direction. The processing of adjusting the exposure timings is performed by forming an exposure position adjustment pattern on a sheet S, detecting the toner concentration of the pattern image by the toner concentration sensor 90, and reflecting the detection result to the exposure timings (i.e., exposure start timings).

Figure 3:
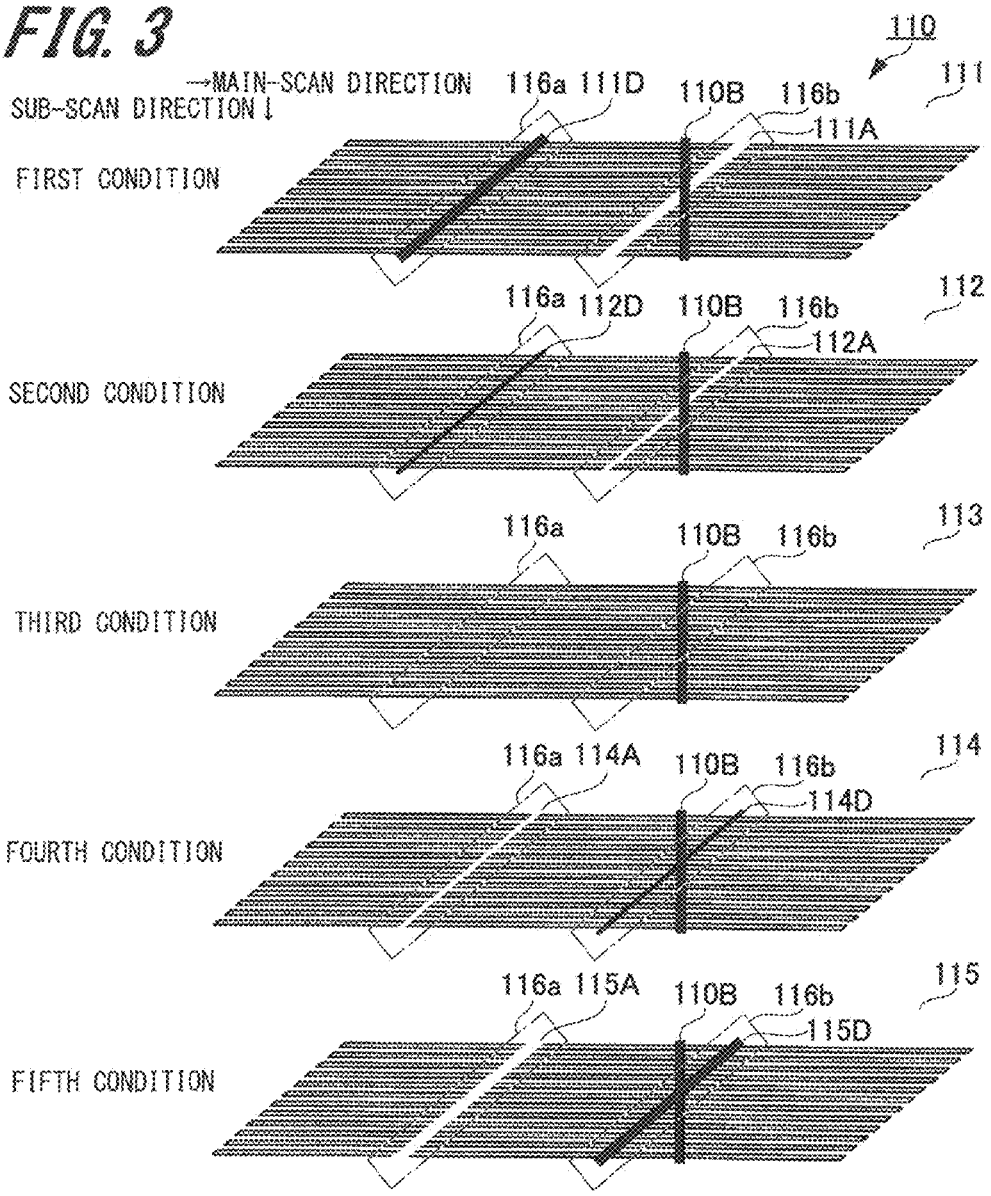
FIG. 3 is an explanatory diagram of a pattern image according to the first embodiment.

FIG. 3 shows a pattern image according to a first embodiment. In FIG. 3, the horizontal direction corresponds to the main-scan direction and vertical direction corresponds to the sub-scan direction.

The pattern image for the exposure position adjustment is formed on the sheet S (example of transfer material) as patch-like pattern images 110 as shown in FIG. 3. In the drawing, the arrow in the horizontal direction expresses the main-scan direction and the arrow in the vertical direction expresses the sub-scan direction. An exposing portion 43 is assumed to perform the surface scan of a photoreceptor 41 with a plurality of light beams in the main-scan direction from the left to the right of FIG. 3. In the example, five patches 111 to 115 formed in different exposure timing conditions (first condition to fifth condition) are arranged in the pattern image 110 in the sub-scan direction orthogonal to the main-scan direction. The pattern is the same among the patches 111 to 115 on the image data. Here, a black line 110B is generated at a random position in the main-scan direction in the pattern image 110 (patches 111 to 115) of FIG. 3.

In the present embodiment, the delay time of the exposure start timing is the same between the light beams neighboring in the sub-scan direction, emitted from the same light source. Accordingly, in each of the patches 111 to 115 of the pattern image 110, parallelograms (three in the example of FIG. 3) configured with line images by a plurality of light beams are formed periodically in the main-scan direction. Therefore, the direction of a boundary part (e.g., overlap part or separation part) between the neighboring parallelograms (between the line images) in each of the patches 111 to 115 is shifted from the sub-scan direction and does not coincide with the sub-scan direction. That is, a boundary part between line images by one light beam in the main-scan direction and line images by another light beam in the main-scan direction is formed so as to be shifted from the sub-scan direction. Therefore, even when process noise such as the black line 110B is generated, the overlap part and the separation part do not coincide perfectly with or become perfectly parallel to the process noise generated in the sub-scan direction. The pattern image 110 like this is formed for each of the first to fourth image forming units 40Y, 40M, 40C, and 40BK corresponding to the toner image colors.

Figure 4:
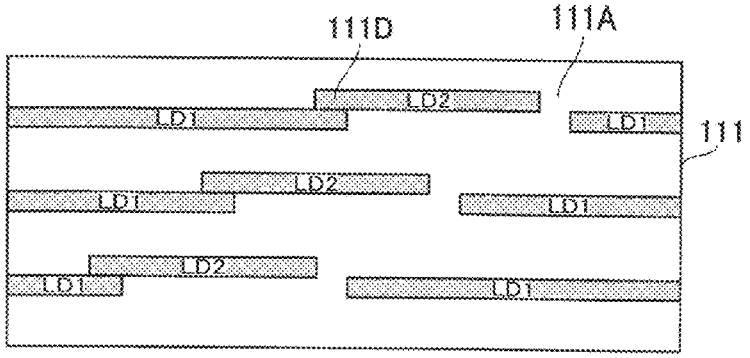
FIG. 4 is an enlarged view of a patch formed within the pattern image of FIG. 3 in a first condition.

FIG. 4 is a partially-enlarged view of the patch 111 formed in the pattern image 110 of FIG. 3 in the first condition. In FIG. 4, the black line 110B in the pattern image 110 of FIG. 3 is omitted. Here, for simple explanation, an exposing portion 43 is assumed to include two light sources separated by certain distances in the main-scan direction and in the sub-scan direction. Out of the two light sources, a first light source is denoted by "LD1", and a second light source is denoted by "LD2". Line images by the light beam of LD1 and line images by the light beam of LD2 are formed repeatedly in the sub-scan direction. Under the control of the CPU 101, the pattern image 110 is formed including the line images which extend in the main-scan direction arranged periodically, while having a predetermined pitch in the sub-scan direction for each of the light beams, and the pattern image 110 is transferred and fixed onto the sheet S.

In the first condition, the exposure timing of LD2 is advanced from the most appropriate exposure timing, and thus a wide overlap part 111D is generated between line images by LD2 and line images by LD1 on the left side thereof and also a wide separation part 111A is generated between the line images by LD2 and line images by LD1 on the right side thereof.

In the second condition, the exposure timing of LD2 is advanced slightly from the most appropriate exposure timing and thus an overlap part 112D having a narrow width is generated between line images by LD2 and line images by LD1 on the left side thereof, and also a separation part 112A having a narrow width is generated between the line images by LD2 and line images by LD1 on the right side thereof.

In the third condition, the exposure timing of LD2 is almost the most appropriate exposure timing, and thus a separation part is generated scarcely between line images by LD2 and line images by LD1, and also an overlap part is scarcely generated between the line images by LD2 and line images by LD1 on the right side thereof.

In the fourth condition, the exposure timing of LD2 is delayed slightly from the most appropriate exposure timing, and thus a separation part 114A having a narrow width is generated between line images by LD2 and line images by LD1 on the left side thereof, and also an overlap part 114D having a narrow width is generated between the line images by LD2 and line images by LD1 on the right side thereof.

In the fifth condition, the exposure timing of LD2 is delayed from the most appropriate exposure timing, and thus a separation part 115A having a wide width is generated between line images by LD2 and line images by LD1 on the left side thereof, and also an overlap part 115D having a wide width is generated between the line images by LD2 and line images by LD1 on the right side thereof. In the above first condition to fifth condition, each of the separation parts and each of the overlap parts do not lie in the sub-scan direction (having a certain angle with respect to the sub-scan direction), and therefore do not coincide perfectly with the black line 110B.

In the present embodiment, the toner concentration sensor 90 detects the toner concentration of a certain area (inspection area 116*a*, 116*b*) including a boundary part between line images by one light beam (LD1) and line images by another light beam (LD2) within the pattern image 110 in the main-scan direction, and the toner concentration of a certain area (non-inspection area 117 to be described in FIG. 5) including a non-boundary part except the boundary part. Since the boundary part between the line images by the one light beam and the line images by the another light beam is arranged so as to be shifted from the sub-scan direction, even when the process noise is generated within the pattern image 110, the influence of the process noise to the toner concentration of the inspection area including the boundary part is suppressed into a certain range. Then, the CPU 101 adjusts the exposure timings of the plurality of light beams on the basis of a difference between the toner concentration of the inspection area and the toner concentration of the non-inspection area. At this time, processing of deforming the pattern image 110 may be performed for simplifying calculation by the CPU 101.

Figure 9:
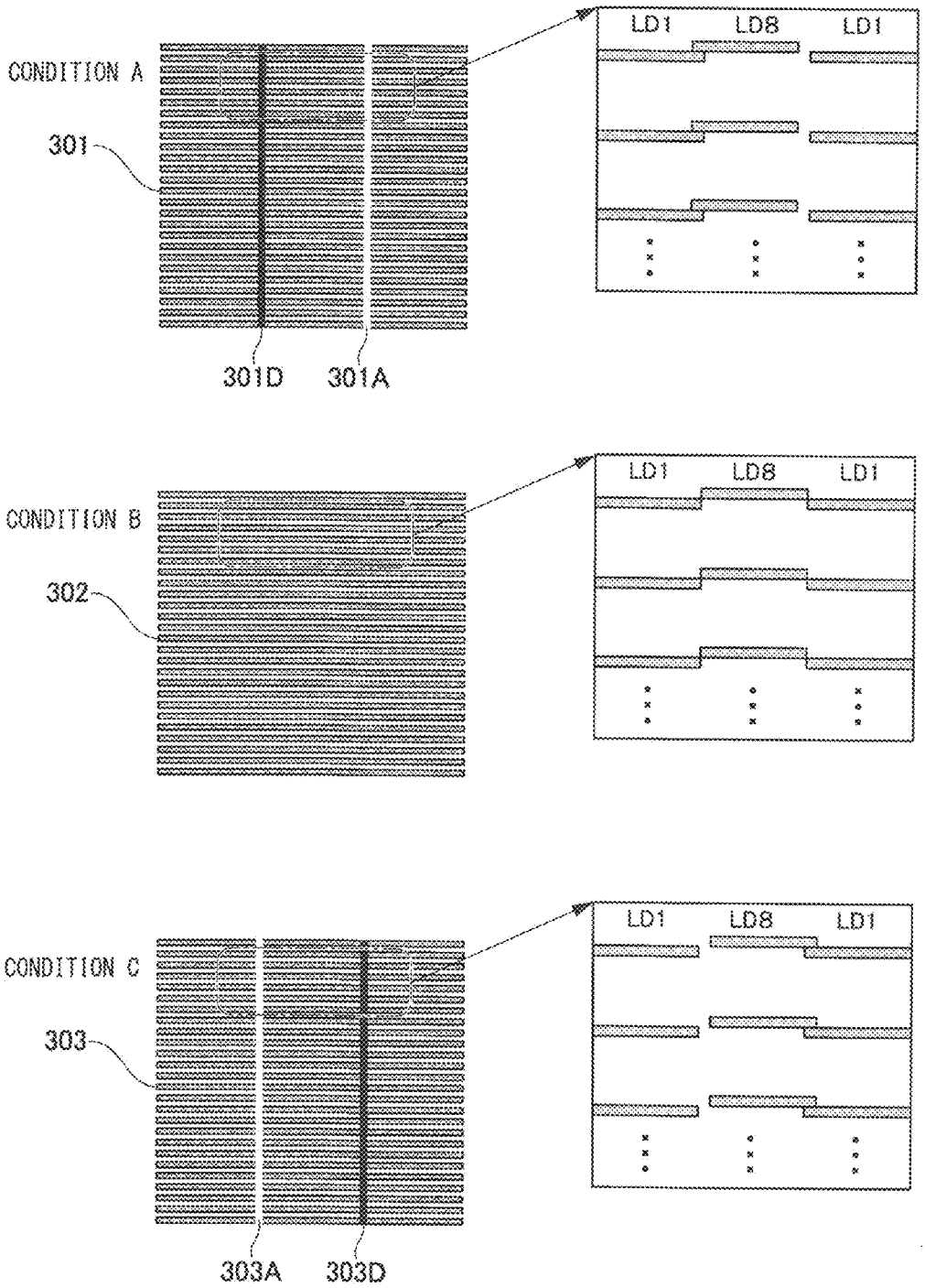
FIG. 9 is an explanatory diagram showing an example of a plurality of line images exposed by a plurality of light beams emitted from a plurality of light sources.
Figure 10A:
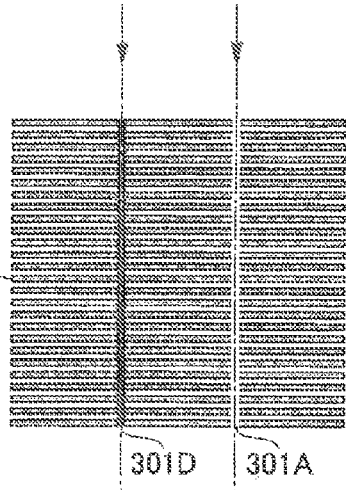
FIG. 10A PRIOR ART
FIG. 10A-FIG. 10F are diagrams explaining a problem of a conventional exposure position adjusting method.
Figure 10B:
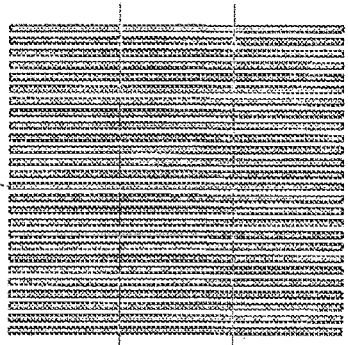
FIG. 10B PRIOR ART
Figure 10C:
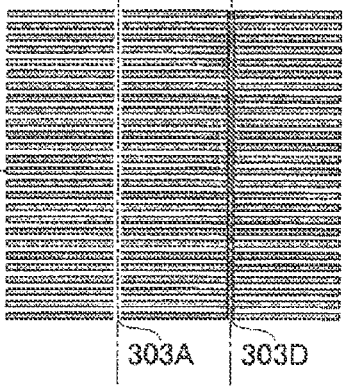
FIG. 10C PRIOR ART
Figure 10D:
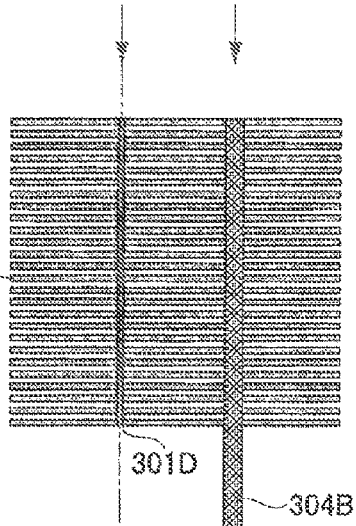
FIG. 10D PRIOR ART
Figure 10E:
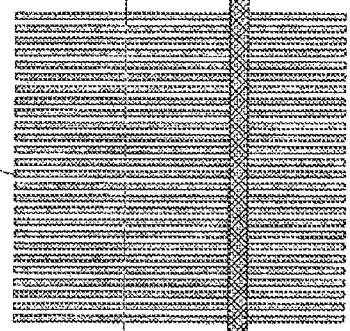
FIG. 10E PRIOR ART
Figure 10F:
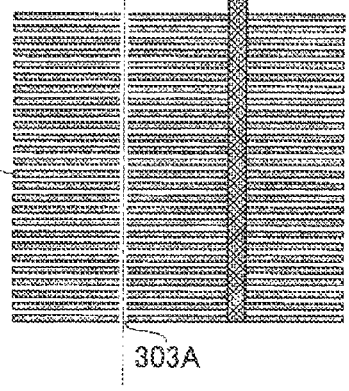
FIG. 10F PRIOR ART

Note that, while the example that the exposing portion 43 includes the two light sources located apart from each other by certain distances in the main-scan direction and the sub-scan direction is shown, the number of light sources may be plural and may be eight as in FIG. 9, for example. Then, the neighboring light beams include light beams emitted from neighboring light sources among the plurality of light sources which is located apart from each other by certain distances in the main-scan direction and the sub-scan direction (e.g., LD1 and LD2, LD1 and LD8, or the like among the eight light sources arranged in the order of LD1 to LD8). Alternatively, the neighboring light beams include light beams having the nearest positional relationship among a plurality of light beams emitted from remaining light sources after the plurality of light sources has been thinned out according to the image data. An example of the neighboring light beams like this includes light beams emitted from LD1 and LD3, and LD3 and LD5 remaining after LD2, LD4, LD6, and LD8 have been eliminated from the eight light sources arranged in the order of LD1 to LD8, and the like.

Figure 5:
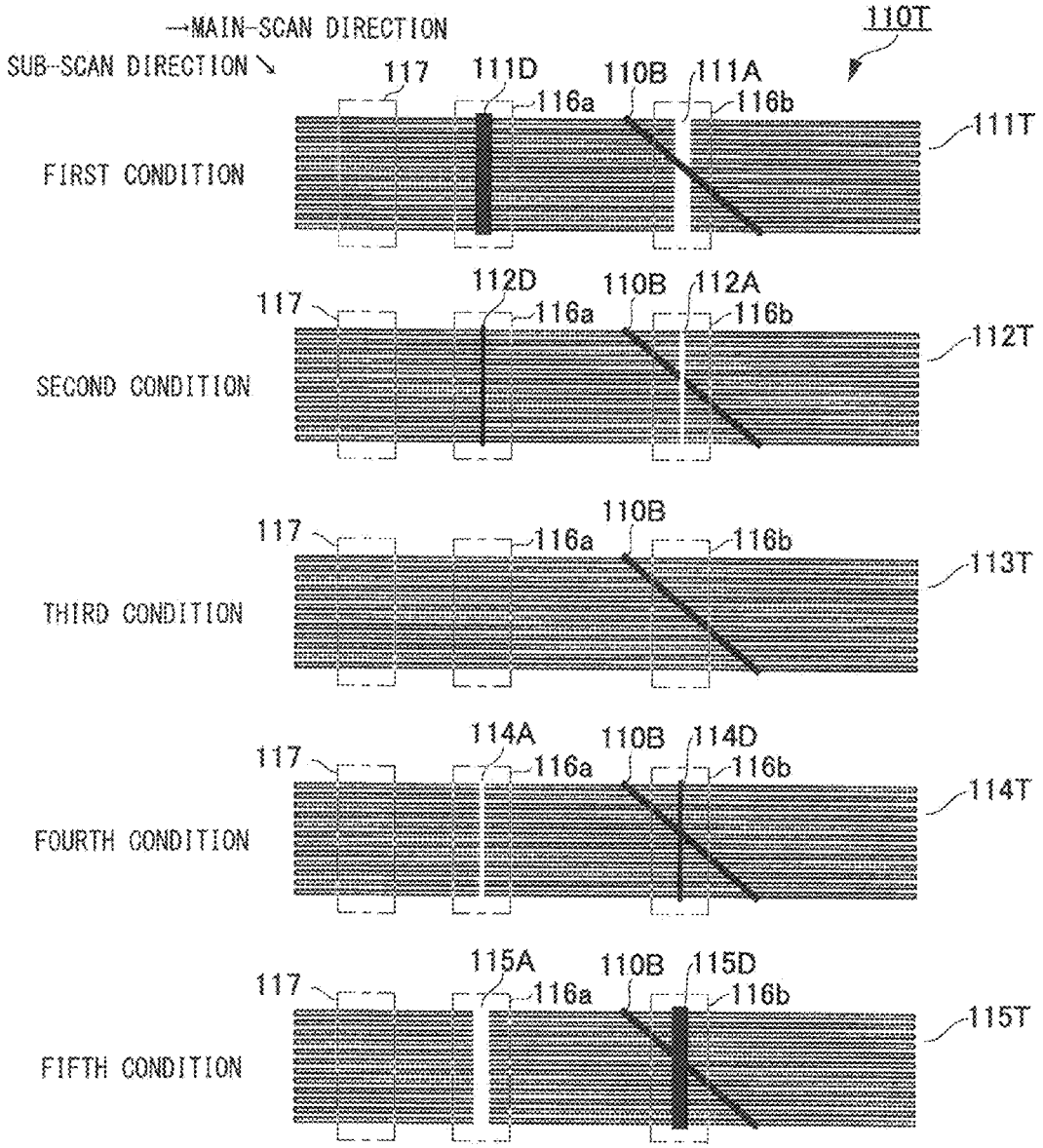
FIG. 5 shows a pattern image after deformation processing has been performed on the pattern image of FIG. 3.

FIG. 5 shows a pattern image after the deformation processing has been performed on the pattern image 110 of FIG. 3 (in the following, referred to as "post-deformation pattern image"). In FIG. 5, the main-scan direction corresponds to the horizontal direction and the oblique direction corresponds to the sub-scan direction.

The image processing section 106 performs the deformation processing on the shapes (parallelograms) of the patches 111 to 115 detected by the toner concentration sensor 90. That is, under the control of the CPU 101, the image processing section 106 performs the deformation processing on the pattern image 110 detected by the toner concentration sensor 90 so that a boundary part between line images by one light beam (LD1) and line images by another light beam (LD2) extends along the sub-scan direction, as shown in FIG. 5.

As shown in FIG. 5, in a post-deformation pattern image 110T, the shapes of the patches 111 to 115 (refer to FIG. 3) in the first to fifth conditions, for example, is deformed into rectangles as shown by patches 111T to 115T. In the post-deformation patches 111T to 115T, three rectangles corresponding to the three parallelograms before the deformation are arranged in the main-scan direction. By the deformation processing of the pattern image like this, each of the inspection area 116*a* or 116*b* including a boundary part and a non-inspection area 117 including a non-boundary part has a vertically-long shape. On the other side, the black line 110B is arranged obliquely (corresponding to the sub-scan direction of FIG. 3). That is, the process noise such as the black line 110B which is not related with the beam pitch becomes oblique image information, and beam pitch information desired to be detected becomes vertical image information.

Here, in the image processing section 106, for example, by carrying out image processing of eliminating an oblique line for the black line 110B which is the oblique image information, it is possible to eliminate the black line 110B from the post-deformation pattern image 110T.

In the following, there will be explained an example of calculating the most appropriate exposure timing (i.e., most appropriate value of the beam pitch) from the toner concentrations of an inspection area 116*a* and a non-inspection area 117 in the post-deformation pattern image 110T. The calculation is the same and explanation will be omitted for the case of the inspection area 116*b*.

Figure 6:
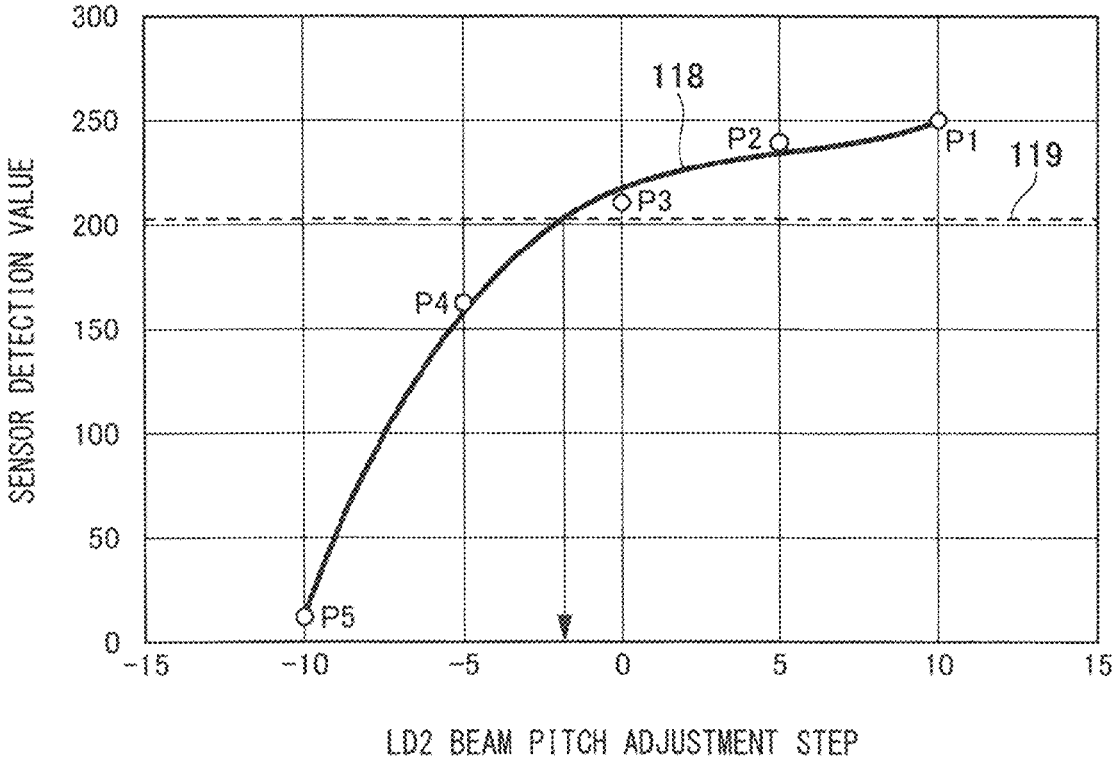
FIG. 6 is a graph showing an example of a relationship between a beam pitch adjustment step and a sensor detection value according to the first embodiment.

FIG. 6 is a graph showing an example of a relationship between a beam pitch adjustment step of LD2 and a sensor detection value. The horizontal axis expresses the beam pitch adjustment step of LD2, and the vertical axis expresses the detection value of the toner concentration sensor 90 (sensor detection value). The sensor detection value of the vertical axis shows a value integrating the toner concentration within the inspection area 116*a*, and a larger value expresses a higher toner concentration. Further, one step in the beam pitch adjustment step is a preliminarily set certain distance, and the number of steps corresponds to the distance from a reference position to an exposure start position (i.e., delay time or advance time from a reference exposure timing). When the value of the beam pitch adjustment step is positive, it shows that the exposure timing is advanced from the reference (step "0") exposure timing, and, when the value is negative, it shows that the exposure timing is delayed from the reference exposure timing. The characteristic curve 118 corresponds to an approximate formula calculated based on measurement points P1 to P5 which are obtained in the respective first to fifth conditions. The average value 119 (broken line) shows an average value of integrated values of toner concentrations in the non-inspection areas 117 across the patches 111T to 115T in the first to fifth conditions.

When the toner concentration is the same in the inspection area 116*a* (or 116*b*) and the non-inspection area 117 of the post-deformation pattern image 110T, the beam pitch (interval) is the same between a plurality of line images by a light beam of a measurement target (LD2) and a plurality of line images by a light beam of a comparison target (LD1). Accordingly, by setting a condition such that the toner concentration of the inspection area 116*a* (or 116*b*) becomes the same as the toner concentration of the non-inspection area 117, according to the correlation or the approximate formula (characteristic curve 118) between the beam pitch adjustment step and the sensor detection value, it is possible to obtain the most appropriate exposure timing.

In the example of FIG. 6, the sensor detection value (toner concentration) in the inspection area 116*a* for measurement point 3 (third condition) is nearest to an average value 119 of the toner concentration in the non-inspection area 117. Accordingly, the CPU 101 preserves the third condition, that is, beam pitch adjustment step "0" in the ROM 102 or the HDD 104, as the most appropriate exposure timing condition.

Note that, while the third condition provides the most appropriate exposure timing in the above example, sometimes the most appropriate exposure timing is obtained in another condition. For example, as shown in FIG. 6, there could be the case that the sensor detection value of the inspection area (i.e., characteristic curve 118) and the toner concentration of non-inspection area 117 (i.e., average value 119) coincide with each other in the middle point of two different beam pitch adjustment steps. In this case, interpolation processing is performed using two beam pitch adjustment steps close to the cross point of the characteristic curve 118 and the average value 119, to calculate the most appropriate exposure timing.

[Operation of the Image Forming Apparatus]

In the following, the operation of the image forming apparatus 1 will be explained.

Figure 7:
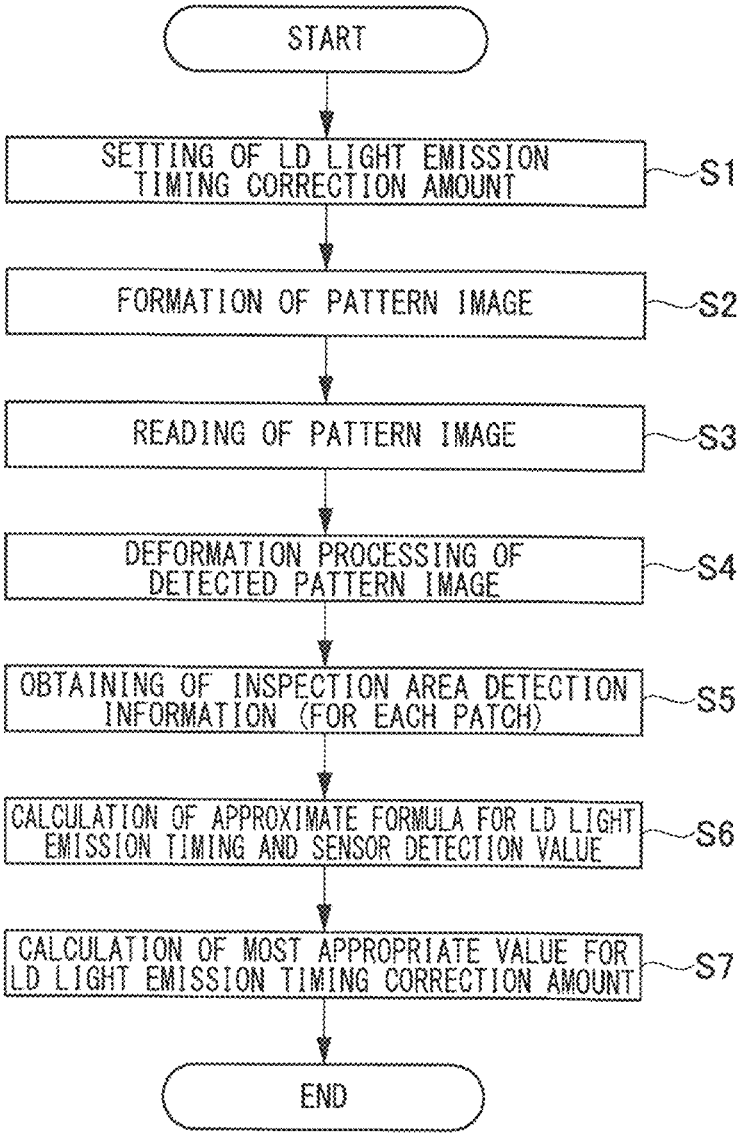
FIG. 7 is a flowchart showing exposure position adjusting processing according to the first embodiment.

FIG. 7 is a flowchart showing exposure position adjusting processing in the image forming apparatus 1. The CPU 101 realizes the processing shown in FIG. 7 by executing a program recorded in the ROM 102. For example, the following processing is performed before the shipment of an image forming apparatus, when failure occurs after delivery to a customer, or the like.

First, the CPU 101 of the image forming apparatus 1 detects job start of the exposure position adjustment by an operation signal input from the operation display section 105, or job information transmitted from the PC 120 via the communication section 108. When detecting the job start of the exposure position adjustment, the CPU 101 reads a correction value of the exposure timing in each of LDs of the exposing portion 43 (described in the drawing as "light emission timing") from the ROM 102 and sets the correction value in the RAM 103 (step S1). The correction value is a delay time or an advance time to be set with respect to a reference exposure timing, and corresponds to the beam pitch adjustment step explained in FIG. 6. The CPU 101 sets the exposure timings for the first condition to fifth condition (refer to FIG. 3) in LD2, for example.

Next, the CPU 101 reads the pattern image 110 (refer to FIG. 3) from the ROM 102 and set the pattern image 110 in the RAM 103. Then, the CPU 101 controls the exposing portion 43 (e.g., LD1 and LD2) of the image forming apparatus 1 according to the pattern image 110, forms the patches 111 to 115 of the pattern images 110 on the photoreceptor 41 in the first condition to fifth condition (step S2). The pattern image 110 formed on the photoreceptor 41, after having been transferred to the intermediate transfer belt 50, is transferred to a sheet S in the secondary transfer section 70, and conveyed to near the toner concentration sensor 90 after having passed through the fixing section 80.

Next, the CPU 101 reads the pattern image 110 through the toner concentration sensor 90 (step S3).

Next, the CPU 101 causes the image processing section 106 to perform the deformation processing on the pattern image 110 read by the toner concentration sensor 90, and obtains the post-deformation pattern image 110T and stores the post-deformation pattern image 110T into the RAM 103 (step S4).

Next, the CPU 101 obtains the toner concentrations of the inspection areas 116*a* (or 116*b*) and the non-inspection areas 117 within the patches 111 to 115 from the pattern image 110 read by the toner concentration sensor 90, and stores the detection result into the RAM 103 (step S5).

Next, the CPU 101 calculates the approximate formula (characteristic curve 118) of a correction value (beam pitch adjustment step) of the exposure timing in an LD to be measured (e.g., LD2) and the sensor detection value (refer to FIG. 6) (step S6). Further, the CPU 101 calculates an average value 119 of the toner concentrations of the non-inspection areas 117 within the patches 111 to 115 of the pattern image 110.

Next, the CPU 101 selects the most appropriate condition from the cross point of the approximate formula of FIG. 6 (characteristic curve 118) and the average value 119. In the example of FIG. 6, the most appropriate condition is the third condition corresponding to measurement point P3. Then, the CPU 101 calculates the most appropriate value of the correction amount in the exposure timing of LD2 according to the selected most appropriate condition (step S7). In the example, the correction value (beam pitch adjustment step) of the most appropriate value is zero steps.

Next, when causing an exposing portion 43 to perform exposure according to the image data in the following jobs, the CPU 101 sets zero steps for the exposure timing of LD2 with respect to the reference timing, and performs the exposure. Preferably, the above series of processing is performed on the light sources emitting neighboring light beams such a LD1 and LD8 (refer to FIG. 9).

As described above, the first embodiment performs the exposure while changing the exposure timings of the plurality of light beams, forms the pattern image 110 including the plurality of patches 111 to 115, and transfers and fixes the pattern image 110 onto the sheet. Here, in the pattern image 110, the line images extending in the main-scan direction are formed periodically while having a predetermined pitch in the sub-scan direction, and also a boundary part (overlap part or separation part) between line images by one light beam (LD1) and line images which neighbor the line images by the one light beam and are formed by another light beam (LD2), is formed so as to be shifted from (not to coincident with) the sub-scan direction. Then, the exposure timing is determined (adjusted) for each of the plurality of light beams in the exposing portions 43 of the image forming section 40 on the basis of the toner concentration of the boundary part (inspection area 116*a* or 116*b*) between the line images by the one light beam and the line images by the another light beam in the main-scan direction and the toner concentration of the non-boundary part (non-inspection are 117) in the pattern image 110 detected by the toner concentration sensor 90

According to the above configuration, since the boundary part of the line images by the one light beam and the line images by the another light beam is arranged so as to be shifted from the sub-scan direction, even when the process noise is generated within the pattern image 110, the influence of the process noise to the toner concentration of the inspection area 116*a* or 116*b* including the boundary part can be suppressed into a certain range. Therefore, it is possible to suppress the influence of the process noise or the like after the exposure and to appropriately adjust the beam pitch of the plurality of light beams in the main-scan direction.

Note that, even when the image of the process noise such as the black line 110B is eliminated from the pattern image 110, the influence of the eliminated image to the toner concentration of the inspection area 116*a* or 116*b* remains in a certain range. Also when the image of the process noise is eliminated, however, it is possible to suppress the influence of the process noise or the like after the exposure and to appropriately adjust the beam pitch of the plurality of light beams in the main-scan direction.

2. Second Embodiment

While, in the first embodiment described above, the deformation processing is performed on the pattern image 110, and the inspection areas 116*a* and 116*b* are expressed as the vertical image information and the process noise is expressed as the oblique image information, the deformation processing may not be performed. That is, in a second embodiment, the exposure position adjustment processing is performed in the state that the inspection areas 116*a* and 116*b* are formed obliquely.

Figure 8:
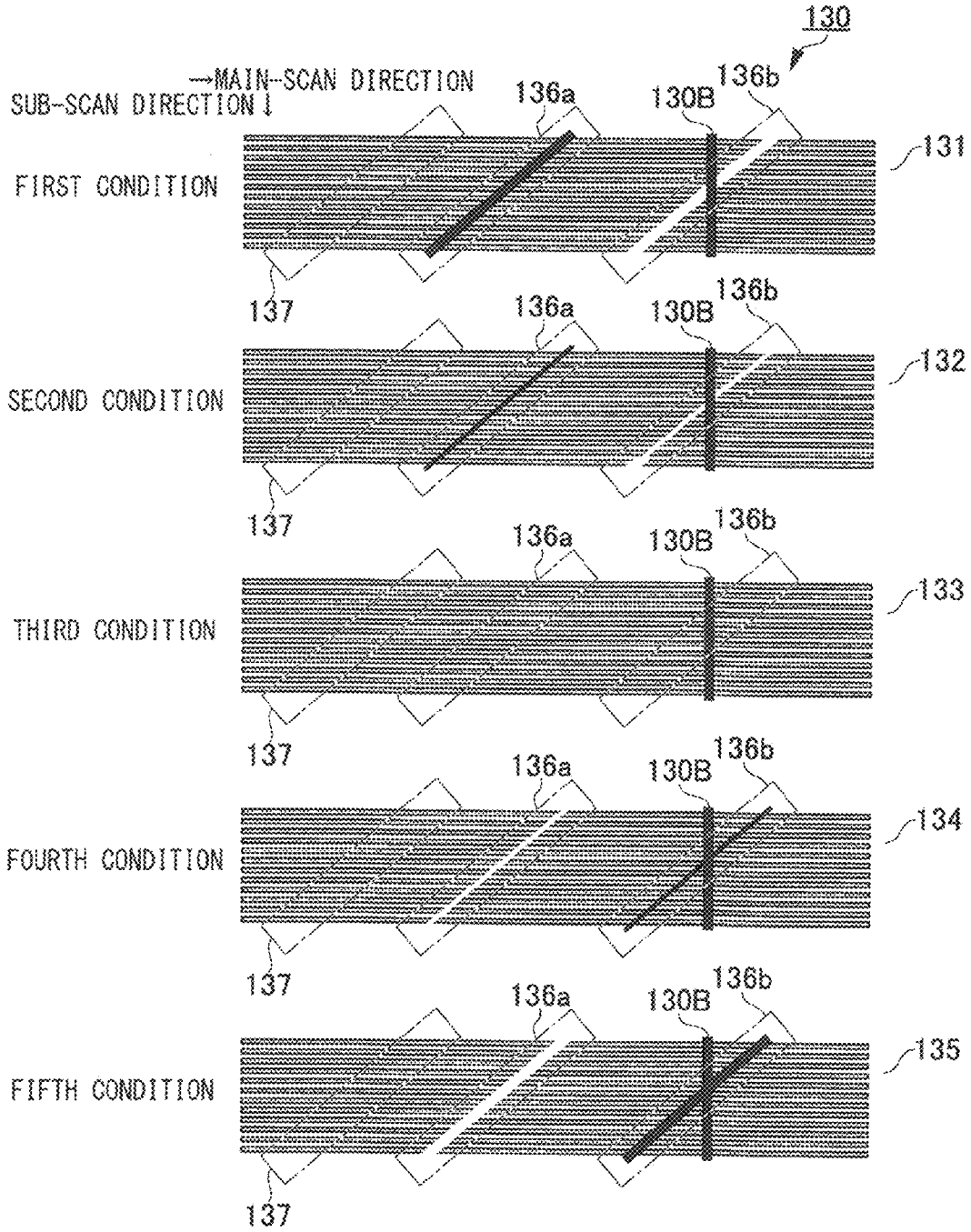
FIG. 8 is an explanatory diagram of a pattern image according to a second embodiment of the present invention.

FIG. 8 shows a pattern image according to the second embodiment of the present invention. When the pattern image 130 is formed, as in FIG. 3, the exposing processing of the pattern image 130 is assumed to be performed by LD1 and LD2.

In the pattern image 130, five patches 131 to 135 having different exposure timing conditions (first condition to fifth condition) are arranged in the sub-scan direction orthogonal to the main-scan direction. All the patterns within the patches 131 to 135 are the same on the image data. Here, a black line 130B is generated at a random position in the main-scan direction in the pattern image 130 (patches 131 to 135) of FIG. 8.

The present embodiment aligns the left end of the pattern image 130 in the sub-scan direction, by performing exposure causing the light beams to have the same exposure start timing. After that, the exposure timing (exposure start timing and exposure time) in each of the light beams is adjusted, and thereby the boundary part of line images by one light beam (e.g., LD1) in the main-scan direction and line images by another light beam (e.g., LD2) in the main-scan direction is formed so as to have a certain angle with respect to the sub-scan direction. That is, the boundary part is formed so as to be shifted from (not to coincide with) the sub-scan direction. Then, the right ends of the pattern image are aligned in the sub-scan direction by causing the light beams to have the same exposure end timing. In the pattern image 130 like this, inspection areas 136*a* and 136*b* and a non-inspection area 137 in each of the patches 131 to 135 become oblique image information, and the black line 130 becomes vertical image information along the sub-scan direction. Accordingly, in the image processing section 106, for example, image processing of eliminating a vertical line is performed on the black line 130B which is the vertical image information, and the black line 130B is eliminated from the pattern image 130.

Angle information (positional information) of the boundary parts (inspection areas 136*a* and 136*b*) and the non-inspection area 137 in the pattern image 130 is obtained from the image data (exposure timing data) of the pattern image 130. The CPU 101 can obtain the toner concentrations of the inspection areas 136*a* and 136*b* and the non-inspection area 137 precisely from the pattern image 130 detected by the toner concentration sensor 90, based on the angle information stored in the ROM 102 or the like.

By the formation of the pattern image 130 like this, as in the case of the first embodiment, even when the process noise such as the black line 130B is generated, the overlap part or the separation part does not coincide perfectly with the process noise generated in the sub-scan direction. Therefore, it is possible to suppress the influence of the process noise or the like after the exposure, and to appropriately adjust the beam pitch of the plurality of light beams in the main-scan direction. Further, since the deformation processing is not performed on the pattern image, processing load is reduced in the image processing section 106.

The embodiments to which the invention achieved by the present inventors is applied have been explained in the above. However, the present invention is not limited to the argument and drawings which form parts of the disclosure of the invention according to the above embodiments, and can be carried out variously modified within a range without departing from the gist of the invention described in claims.

For example, while, in the above first and second embodiments, a configuration is illustrated as follows; the pattern image including the plurality of patches is formed while changing the exposure timings of the plurality of light beams, the toner concentrations of the pattern image are detected, and the exposure timings of the plurality of light beams are adjusted, the configuration of the present invention is not limited to the above example. The configuration of the present invention may be one that a correlation of the beam pitch adjustment step and the variation amount of the toner concentration, for example, is preliminarily obtained, and the exposure timings of the plurality of light beams are adjusted based on the above correlation and a difference between the toner concentration of a boundary part (inspection area) between line images by one light beam and line images by another light beam and the toner concentration of a non-boundary part (non-inspection area).

Further, a boundary part between line images by one light beam and line images by another light beam may have a shape shifted from (without coinciding with) the sub-scan direction, and may meander or may be curved or bent along the sub-scan direction, for example.

Further, while the configuration that the toner concentration sensor 90 detects the toner concentration of the pattern image on the sheet S is illustrated in the above first and second embodiments, the configuration of the present invention is not limited to this case. For example, the toner concentration sensor 90 may be configured to detect the toner concentration of the pattern image formed on the transfer material such as the photoreceptor 41 and the intermediate transfer belt 50.

Further, while the image forming apparatus of an electrophotographic type is explained in the above first and second embodiments, the present invention can be applied to an image forming apparatus except the electrophotographic type image forming apparatus.

REFERENCE SIGNS LIST

1 image forming apparatus
40 image forming section
43 exposing portion
90 toner concentration detecting section
110 pattern image
110B black line
110 to 115 patch
111T to 115T post-deformation patch
116*a*, 116*b* boundary part
117 non-inspection area
101 CPU
102 ROM
103 RAM
118 characteristic curve
119 average value

What is claimed is:

1. An image forming apparatus comprising:

an image forming section configured to form a pattern image in which line images extending in a main-scan direction of a photoreceptor are formed periodically while having a predetermined pitch in a sub-scan direction of the photoreceptor by scanning of the photoreceptor with a plurality of light beams emitted from an exposing portion, and also a boundary part between line images formed by one light beam and line images formed by another light beam neighboring the one light beam is arranged so as to be shifted from the sub-scan direction of the photoreceptor;

a toner concentration detecting section configured to detect a toner concentration of the pattern image on the photoreceptor or the transferred pattern image which has been transferred from the photoreceptor to a transfer material; and a control section configured to calculate exposure timings for the plurality of light beams in the image forming section on the basis of a toner concentration of the boundary part and a toner concentration of a part except the boundary part, the toner concentrations being detected by the toner concentration detecting section.

2. The image forming apparatus according to claim 1, wherein the image forming section forms the pattern image by varying exposure timings, wherein the toner concentration detecting section detects a toner concentration of the boundary part between the line images by the one light beam and line images by the another light beam in the pattern image, for each of the exposure timings, and wherein the control section calculates the exposure timings for the plurality of light beams in the image forming section on the basis of the toner concentration of the boundary part and the toner concentration of the part except the boundary part, the toner concentrations being detected by the toner concentration detecting section.

3. The image forming apparatus according to claim 2, wherein the control section calculates the exposure timings for the plurality of light beams in the image forming section so as to minimize a difference between the toner concentration of the boundary part and the toner concentration of the part except the boundary part in the pattern image, the toner concentrations being detected by the toner concentration detecting section.

4. The image forming apparatus according to claim 3, wherein the control section calculates an approximate formula to show a relationship between each of the exposure timings and the toner concentration of the boundary part, and calculates an exposure timing of a case that the toner concentration of the boundary part is nearest to the toner concentration of the part except the boundary part, from the approximate formula.

5. The image forming apparatus according to claim 1, further comprising an image processing section configured to perform deformation processing on the pattern image based on a detection result of the toner concentration detected by the toner concentration detecting section so that the boundary part between the line images by the one light beam and the line images by the another light beam lies in the sub-scan direction, wherein the control section adjusts the exposure timings for the plurality of light beams in the image forming section on the basis of a pattern image after the deformation processing.

6. The image forming apparatus according to claim 1, wherein a boundary part between the line images formed by the one light beam and the line images formed by the another light beam neighboring the one light beam is formed obliquely with respect to the sub-scan direction of the pattern image.

7. An exposure position adjusting method comprising the steps of:

forming, by an image forming section, a pattern image in which line images extending in a main-scan direction of a photoreceptor are formed periodically while having a predetermined pitch in a sub-scan direction of the photoreceptor by scanning the photoreceptor with a plurality of light beams emitted from an exposing portion, and also a boundary part between line images formed by one light beam and line images formed by another light beam neighboring the one light beam is arranged so as to be shifted from the sub-scan direction of the photoreceptor;

detecting, by a toner concentration detecting section, a toner concentration of the pattern image on the photoreceptor or the transferred pattern image which has been transferred from the photoreceptor to a transfer material; and calculating, by a control section, exposure timings for the plurality of light beams in the image forming section on the basis of a toner concentration of the boundary part and a toner concentration of a part except the boundary part, the toner concentrations being detected by the toner concentration detecting section.

* * * * *